US005234287A

United States Patent [19]

Rippe, Jr.

[11] Patent Number: 5,234,287

[45] Date of Patent: Aug. 10, 1993

[54] APPARATUS AND PROCESS FOR STABILIZING FOUNDATIONS

[76] Inventor: Dondeville M. Rippe, Jr., 11361 W. 75 Pl., Arvada, Colo. 80005

[21] Appl. No.: 794,721

[22] Filed: Nov. 15, 1991

Related U.S. Application Data

[63] Continuation-in-part of Ser. No. 656,243, Feb. 14, 1991, abandoned, which is a continuation of Ser. No. 386,878, Jul. 27, 1989, abandoned.

[51] Int. Cl.[5] ..... E02D 17/02

[52] U.S. Cl. ..... 405/230; 405/232

[58] Field of Search ..... 405/229-233; 52/292; 254/29 R

[56] References Cited

U.S. PATENT DOCUMENTS

| | | | |
|---|---|---|---|
| 2,982,103 | 5/1961 | Revesz et al. | 405/230 |
| 3,852,970 | 12/1974 | Cassidy | 405/230 |
| 3,902,326 | 9/1975 | Langenbach | 405/230 |
| 4,070,867 | 1/1978 | Cassidy | 405/231 |
| 4,695,203 | 9/1987 | Gregory | 405/230 |
| 4,708,528 | 11/1987 | Rippe | 405/230 |
| 4,754,588 | 7/1988 | Gregory | 52/294 |
| 4,907,916 | 3/1990 | Hartman | 405/233 X |
| 5,013,190 | 5/1991 | Green | 405/230 |

*Primary Examiner*—Dennis L. Taylor
*Assistant Examiner*—John Ricci
*Attorney, Agent, or Firm*—Polster, Lieder, Woodruff & Lucchesi

[57] ABSTRACT

A foundation having a wall is stabilized by attaching a bracket to the wall, coupling a jacking apparatus to the bracket, inserting pier sections into the jacking apparatus and driving them with that apparatus, one after the other, through the bracket and into the soil which underlies the foundation, and coupling the pier so formed to the bracket so as to support the foundation through the pier. The bracket has a plate which fits against the wall and is attached to it with bolts and a sleeve which is attached firmly to the plate intermediate the ends of the plate. The pier passes through the sleeve and is connected to the sleeve, once it encounters adequate resistance, so as to support the foundation.

19 Claims, 4 Drawing Sheets

FIG. 7.
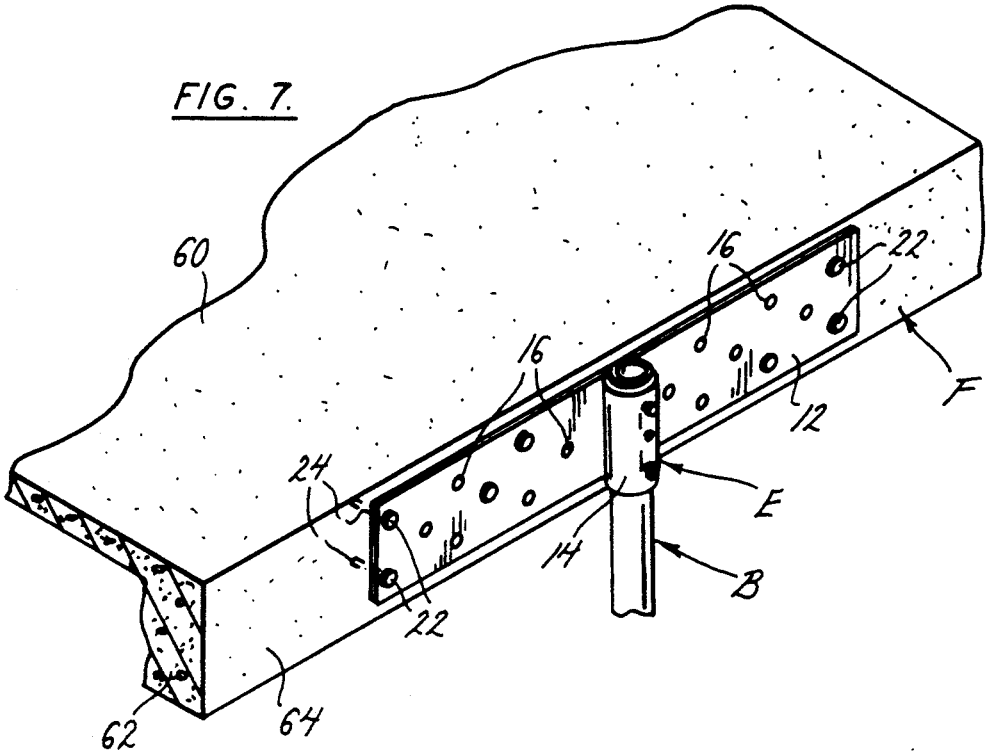
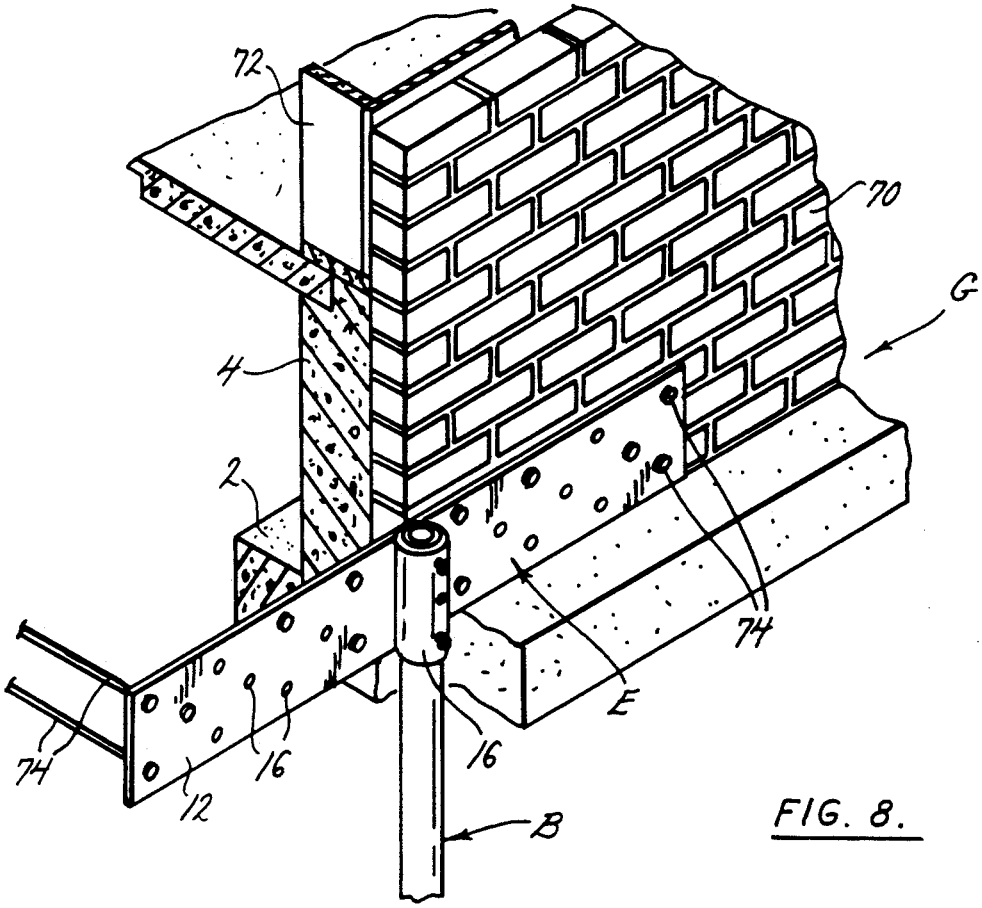
FIG. 8.

FIG. 9.
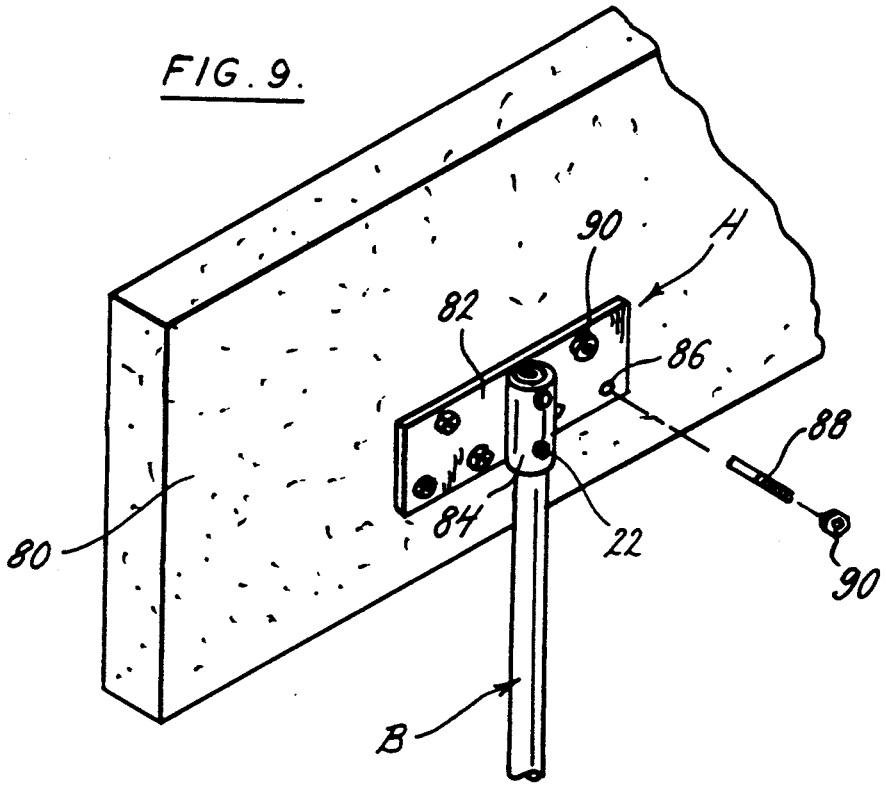
FIG. 10.
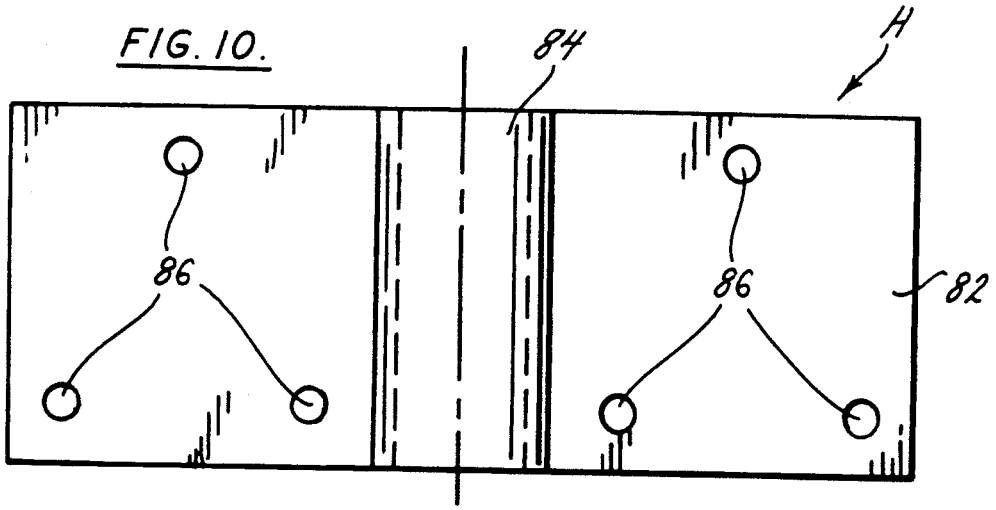
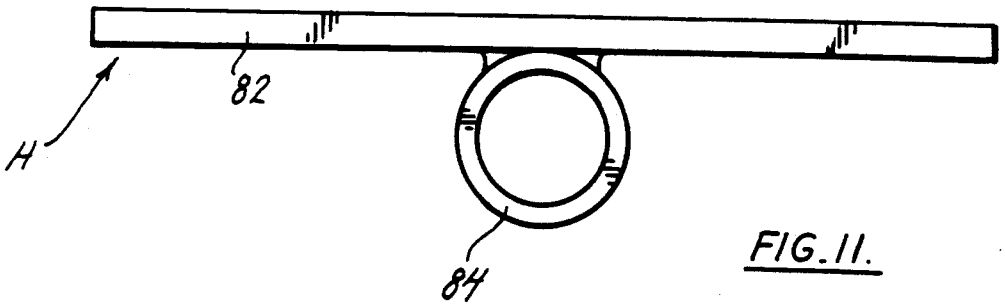
FIG. 11.

APPARATUS AND PROCESS FOR STABILIZING FOUNDATIONS

RELATED APPLICATIONS

This application is a continuation-in-part of application Ser. No. 07,656,243, filed Feb. 14, 1991, now abandoned which is a continuation of application Ser. No. 07/386,878, filed Jul. 27, 1989, now abandoned.

BACKGROUND OF THE INVENTION

This invention relates in general to foundations for buildings and more particularly to an apparatus and process for stabilizing or shoring such foundations.

The traditional procedure for shoring a foundation requires boring a hole into the soil adjacent to the foundation, preferably to bedrock, and then pouring concrete into the hole and beneath the footing of the foundation. The concrete sets up into a solid, cast in place, pier which provides a more stable support than the underlying soil. This procedure can be quite complex and costly, and just as disturbing, results in a considerable amount of damage to lawn and shrubbery, owing to the extensive excavation that is required.

U.S. Pat. No. 4,708,528 describes a less complex procedure that requires very little, if any, excavation. In this procedure a hole is drilled into the foundation wall and a bracket is engaged with the wall at the hole. The bracket has a sleeve and a pin projected from the sleeve, and it is the latter which fits into the hole in the foundation, leaving the sleeve exposed at the face of the foundation. Pier sections are then forced, one after the other, through the sleeve until the pier so formed reaches bedrock. To this end, a so-called jack stand is temporarily attached to the sleeve, and it has a hydraulic jack which bears against the uppermost pier section and forces the entire pier downwardly. Of course, the downwardly directed force that is applied to the pier creates an upwardly directed reaction force, but the jack stand and bracket transfer the reaction force to the foundation which resists it.

The shoring system set forth in U.S. Pat. No. 4,708,528 serves quite well for stabilizing foundations having monolithic walls of substantial height such as those formed from poured concrete for basements or crawl spaces in colder climates where some depth is required to get below the first line. It is less suited for foundations having weaker walls. Typical of such weaker foundations are those formed from blocks laid up in tiers and those used along slabs in warmer climates. The latter appear as concrete beams in that they have relatively little depth.

The present invention resides in a foundation shoring system that is ideally suited for stabilizing relatively weak foundations such as those formed from blocks laid up in tiers or along peripheries of slabs on grade. While it utilizes a bracket having a sleeve through which the pier sections are forced, the sleeve does not engage the foundation through a single pin, but instead through a plate which is against the foundation wall and is secured to the wall with several bolts or other fasteners. The plate covers a significant area of the foundation wall.

DESCRIPTION OF THE DRAWINGS

In the accompanying drawings which form part of the specification and wherein like numerals and letters refer to like parts wherever they occur—

FIG. 7 is a perspective view of a monolithic slab-on-grade foundation stabilized in accordance with the present invention;

FIG. 8 is a perspective view of a brick-faced foundation stabilized in accordance with the present invention;

FIG. 9 is a perspective view of a foundation wall supported by a pier attached to the wall with a modified bracket;

FIG. 10 is an elevational view of the modified bracket; and

FIG. 11 is a top view of the modified bracket.

DETAILED DESCRIPTION

Figure 1:
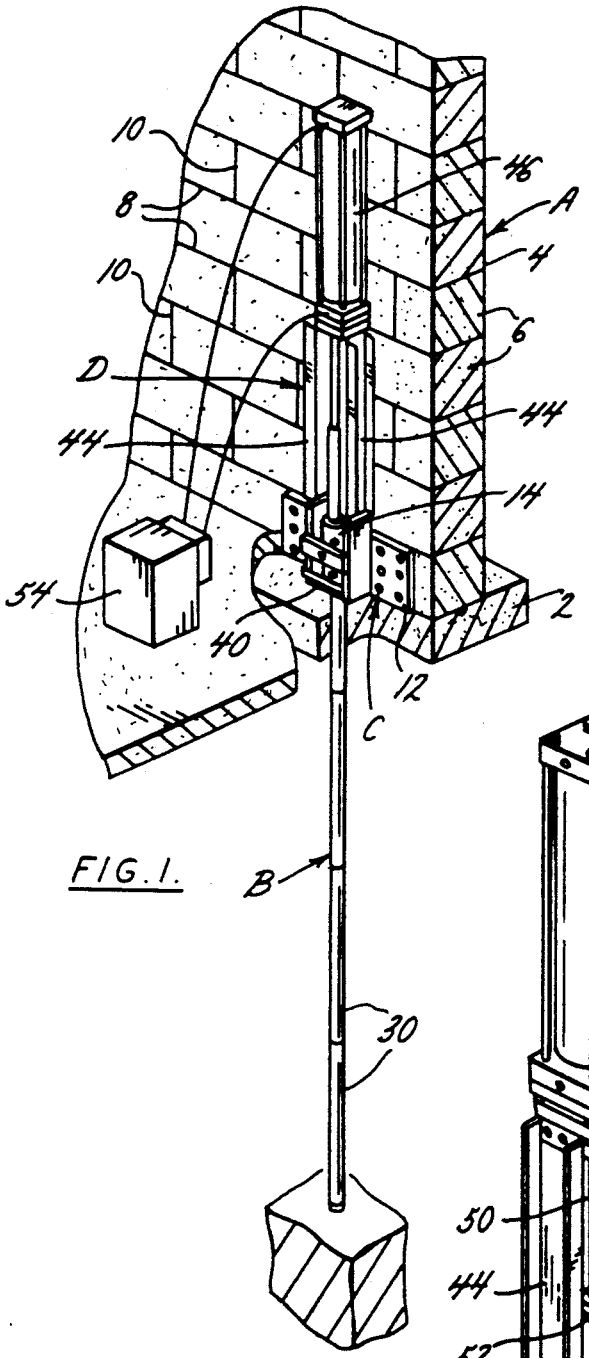
FIG. 1 is a perspective view of a block foundation and an apparatus constructed in accordance with the present invention for driving a pier used to stabilize the foundation.

Referring now to the drawings, a building, which may be residence or a low rise commercial building, has a foundation A (FIG. 1) comprised essentially of a footing 2 and a foundation wall 4 resting on the footing 2. The footing 2 is poured concrete, but the wall 4 consists of concrete blocks 6 laid up in the traditional bond with horizontal and vertical mortar joints 8 and 10. Thus, the blocks 6 exist in several tiers, with the blocks 6 of adjacent tiers being staggered with respect to each other. The horizontal mortar joints 8 exist between the several tiers and of course separate the blocks 6 of those tiers. The vertical mortar joints 10 exist within the individual tiers themselves and separate the blocks 6 of those tiers. By reason of the stagger of the blocks 6 between the tiers, the vertical joints 10 of adjacent tiers are offset. Should the soil beneath the foundation A shift or shrink, the foundation A will settle and perhaps develop a crack which follows some of the mortar joints 8 and 10.

Figure 2:
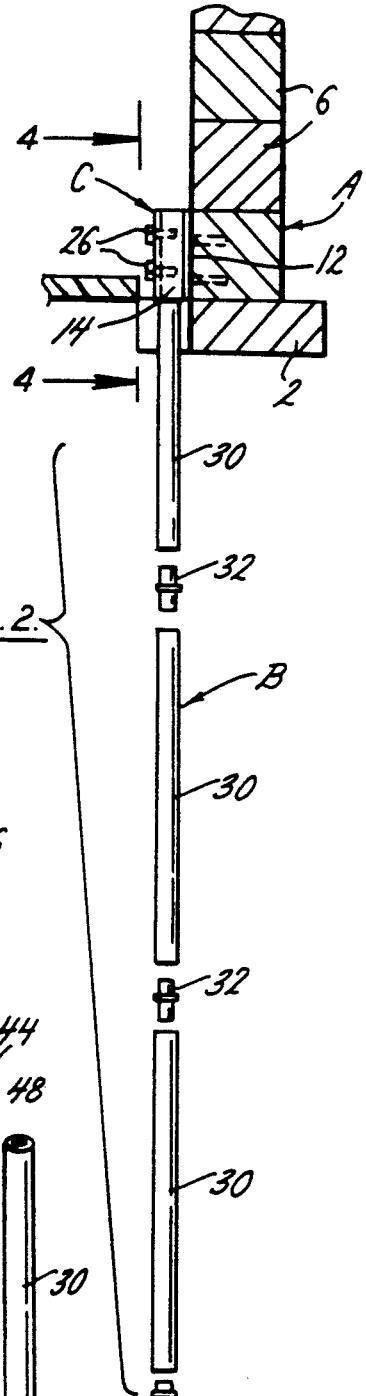
FIG. 2 is a sectional view showing the pier in exploded view and attached to a bracket which is in turn attached to a foundation wall.
Figure 3:
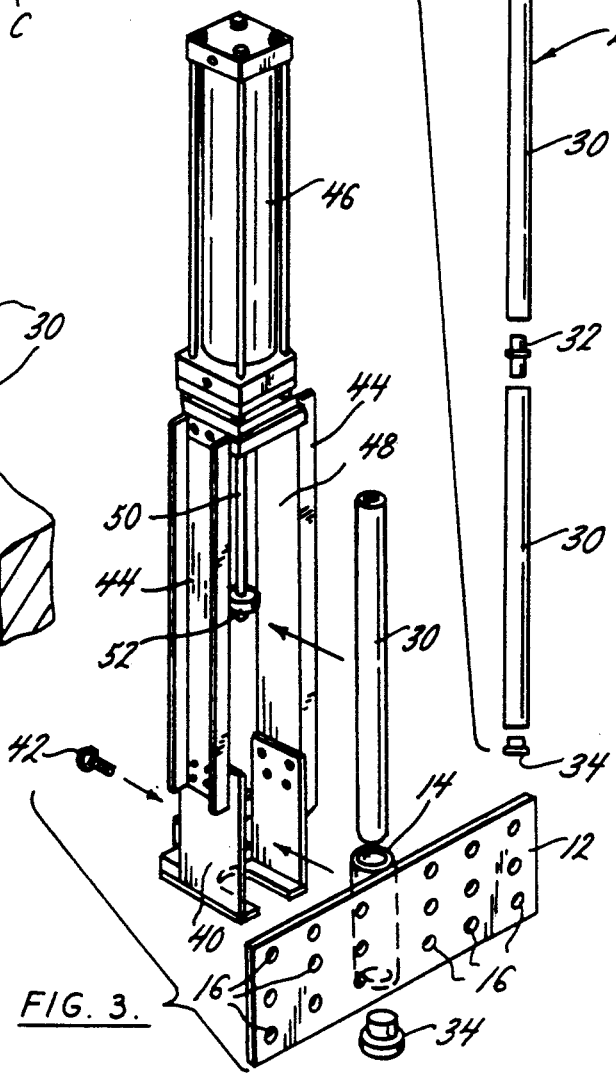
FIG. 3 is perspective view of the jacking apparatus, the bracket and a pier section.

The foundation A is stabilized or shored with a pier B (FIGS. 1 & 2) that extends downwardly into the underlying soil adjacent to the foundation A and is, at its upper end, attached to the foundation wall 4 by a bracket C. Actually, the pier B is forced through the bracket C with a jacking apparatus D (FIGS. 1 & 3), which temporarily couples to the bracket C. Of course, the jacking apparatus D exerts a downwardly directed force on the pier B, and this force creates an upwardly directed reaction force. The latter is transferred through the bracket C to the foundation wall 4 where it is resisted.

Figure 6:
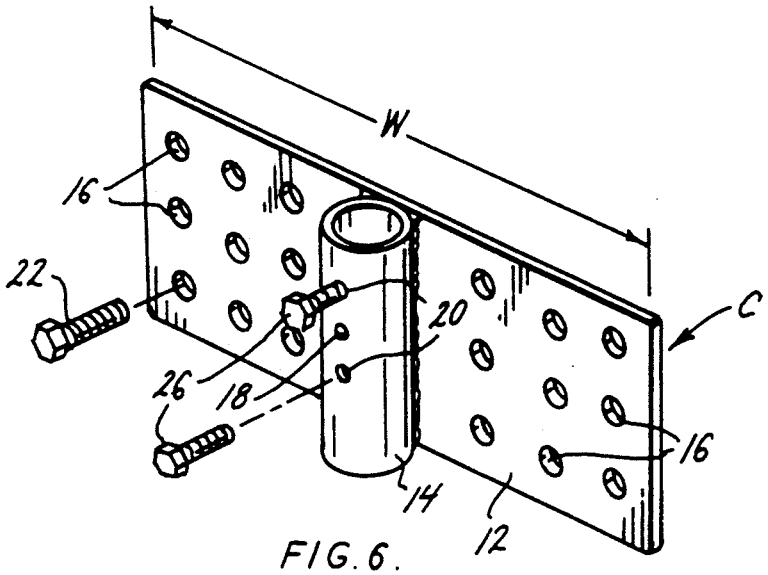
FIG. 6 is a perspective view of the bracket.

The bracket C includes (FIG. 6) a rectangular plate 12 and a sleeve 14 which is attached to the plate 12 midway between its ends. The plate 12 is wider than it is high and is oriented with its major axis parallel to the horizontal mortar joints 10. Its width w exceeds the width of a block 6. Its height may equal or exceed the height of a block 6, it being preferably equal to the height of a block 6. Thus, when the plate 6 is placed against the wall 4 along a tier of blocks 6, its lateral extent is enough to position it over at least two blocks of the tier and preferably three. Typically, the plate 12 measures 8 inches by 21 inches. On each side of the sleeve 14 the plate 12 has plurality of bolt holes 16.

The sleeve 14 extends the full height of the plate 12 and is welded to the plate 12 midway between the ends of the plate 12 with its axis oriented vertically. The inside diameter of the sleeve 14 is slightly greater than the outside diameter of the pier B so that the pier B, unless otherwise restrained, will slide freely within the sleeve 14. The sleeve 14 along the portion thereof that is presented away from the plate 12 has a threaded center hole 18 and two additional threaded holes 20, one above and the other below the center hole 18.

Figure 5:
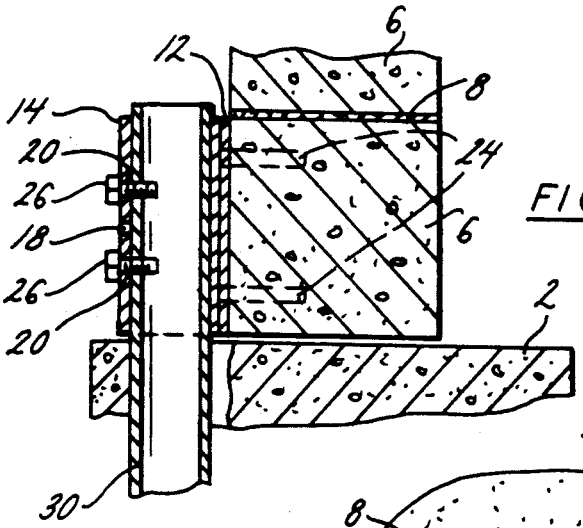
FIG. 5 is a sectional view of the bracket taken along line 5—5 of FIG. 4.
Figure 4:
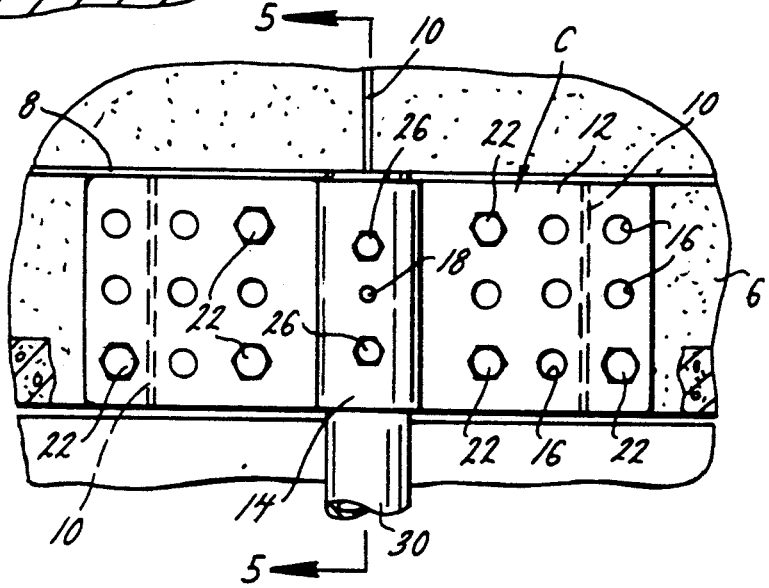
FIG. 4 is a rear elevational view of the bracket attached to the foundation wall and a pier extended from and connected to the bracket.

The bracket C is secured to the foundation wall 4 by bolts 22 which pass through several of the bolt holes 16 in the plate 12 and thread into anchors 24 set into the blocks 6 which the plate 12 overlies (FIGS. 4 & 5). The anchors 24 may be conventional or they may be wedge anchors or epoxy anchors. In this regard, the plate 12 is placed against the wall 4 at the location where the foundation A is to be stabilized and the bolt holes 16 are selected—generally two or three on each side of the sleeve 14—where the bracket C is to be attached to the wall 4. Of course, those holes 16 which are selected should be within the bodies of the blocks 6 which the plate 12 overlies, not in one of the mortar joints 8 or 10. At each hole 16 that is selected a corresponding hole is drilled into the underlying block 6 and an anchor 24 is set in that hole. The bolts 22 thread into the anchors 24 and clamp the plate 12 against the face of the foundation wall 4, thus securing the bracket C firmly to the foundation wall 4.

The bracket C in turn is secured firmly to the pier B by bolts 26 which thread through the holes 20 in the sleeve 14 and pass into the pier B (FIGS. 4 & 5). Thus, the weight of the foundation A is transferred to the pier B at the bracket C. The pier B, while being of extended length, is composed of a plurality of relatively short pier sections 30 of tubular configuration. The pier sections 30 are connected together end-to-end by couplings 32 (FIG. 2) which fit into the pier sections 30 at their ends where they are held in place simply by friction. The lowermost pier section 30 has a cap 34 fitted to its lower end, and the cap 34 has a diameter slightly greater than the outside diameter of the pier sections 30. The uppermost pier section 30 passes through the sleeve 14 of the bracket C, and indeed that pier section is secured to the sleeve 14 by the bolts 26 which thread into the holes 20 of the sleeve 14 and project through the wall of the pier section 30.

The jacking apparatus D couples with the sleeve 14 of the bracket C and serves to drive the pier sections 30, one after the other, through the sleeve 14 and into the underlying soil until the cap 34 at the lower end of the pier B reaches bedrock or the pier B achieves stability by reason of friction along its side surfaces. The jacking apparatus D includes a (FIG. 3) lift member or cradle 40 which fits beneath the sleeve 30 as well as along the sides of the sleeve 30 and around the back of the sleeve 30. Indeed, the cradle 40 has a back wall through which a bolt 42 passes, and this bolt threads into the center hole 18 of the sleeve 30 to temporarily secure the lifting apparatus D to the bracket C. In addition, the jacking apparatus D has tie bars 44 which project upwardly from the cradle 40 at the sides of the cradle 40 and a hydraulic cylinder 46 at the upper ends of the tie bars 44. The tie bars 44, in effect, connect the cylinder 46 to the cradle 40 while providing between the two a space 48 that is large enough to receive a single pier section 30. The cylinder 46 includes a piston rod 50 which, when extended, moves downwardly into the space 48. Here the rod 50 is provided with a head 52 that is large enough to bear against the full end of a pier section 30, yet has a slight projection at its center to locate it with respect to the pier section 30. The lifting apparatus D is essentially the same as the lifting apparatus illustrated and described in U.S. Pat. No. 4,708,528.

To stabilize the foundation A, locations along it are selected for the installation of the piers B. At each location a bracket C is fastened to the wall 4 of the foundation A. Each bracket C is positioned such that its plate 12 lies over at least two blocks 6 and preferably three or more of a single tier with those blocks 6 being exposed through the bolt holes 16 in the plate 12. Holes are drilled into the blocks 6 at the selected holes 16, preferably at least three on each side of the sleeve 14, and into each hole a bolt anchor 24 is fitted. The plate 12 is then fastened against the wall 4 with bolts 22 that pass through the holes 16 in the plate 12 and thread into the bolt anchors 24. The brackets C are thus positioned securely on the wall 4 with the axes of their sleeves 14 oriented vertically.

If the brackets C are against an outside face of the wall 4, a small excavation is made to gain access to the wall 4, since it is desirable to place the brackets C along the lower portion of the wall 4, that is immediately above the footing 2. Directly below the bracket C the footing 2 is chiselled off flush with the face of the wall 4 so that it does not interfere with the pier B. On the other hand, if the brackets C are installed on the inside face of the wall 4, that is from within a basement, the basement floor as broken away immediately below the bracket C to expose the footing 2 which is chiselled off flush with the face of the wall 4.

Once the footing 2 is prepared, the jacking apparatus D are attached to the brackets C. At each bracket C, the cradle 40 of the jacking apparatus D assigned to that bracket C is fitted over the back and beneath the sleeve 14 for the bracket C and once in place is secured with a bolt 42 which passes through the back wall of the cradle 40 and threads into center hole 18 of the sleeve 14. This attaches the jacking apparatus D to the bracket C, although temporarily, and as such the tie bars 44 and cylinder 46 extend upwardly along the wall 4. The cylinder 46 is, of course, connected to a hydraulic pump 54.

At this juncture, the jacking apparatus D is in condition to drive a pier B downwardly into the underlying soil. To this end, the initial pier section 30 is inserted into the space 48 between the two tie bars 44 of the jacking apparatus D—with of course the piston rod 50 retracted—and then is lowered through the sleeve 14. As its lower end emerges from the sleeve 14, a cap 34 is installed on it. Thereupon, pressurized fluid is admitted to the cylinder 46, and this fluid extends the rod 50 into the space 48 between the two tie bars 44. The head 52 of the rod 50 comes against the upper end of the first pier section 30 and forces it into the soil underlying the footing 2. The stroke of the cylinder 46 may equal the length of the pier section 30 or it may be shorter. In the case of the latter, the rod 50 is advanced to its fullest extent and retracted, and then a pusher bar is inserted between the head 52 of the rod 50 and the upper end of the pier section 30, whereupon the rod 46 is again extended to drive the initial section 30 farther into the soil, with the force this time being transmitted through the pusher bar. When the upper end of the first section 30 reaches the sleeve 14, the rod 50 is retracted and a coupling 32 is inserted into the upper end of the section 30. Then another pier section 30 is inserted into the space 48 and its lower end fitted to coupling 32 on the previous section 30. The same procedure is repeated. Indeed, pier sections 30 are connected one after the other and driven, thus increasing the length of the pier B which is so formed. The end cap 34, being slightly larger than the pier sections 30 clears the way and reduces skin friction. When the cap 34 on the initial pier section 30 reaches bedrock or the pier B otherwise meets with resistance sufficient to support the foundation A, the cylinder 46 is brought to a predetermined pressure to apply an upwardly directed force to the foundation A. With the force applied, the hydraulic lines to the cylinder 46 are blocked. The fluid is thus captured in the cylinder 46 under pressure by reason of the weight of the foundation A being in effect transferred to the pier through the cylinder 46. This condition is maintained for perhaps 20 minutes. If the pressure in the cylinder 46 remains constant, that absence of a change signifies that the pier B has not moved and is indeed stable.

Assuming that the pier B is stable, holes are bored through the wall of the uppermost pier section at the two threaded holes 20 in the sleeve 14. Indeed, the threaded holes 20 serve to pilot the drill bit used to produce the holes in the pier section 30. Then bolts 26 are threaded through the holes 20 in the sleeve 14 and into the holes bored in the pier section 30. This locks the pier B to the bracket C while the pier B carries the foundation A. At this time the valves which block the cylinder 46 are opened and the cylinder barrel is in effect vented to a reservoir for hydraulic fluid. The jacking apparatus D is detached by removing the bolt 42 and withdrawing it from the sleeve 14. Thereafter, that portion of the last pier section 30 which rises above the sleeve 14 is cut off, preferably with a cutting torch. Finally, the excavation is filled with soil or the basement floor restored, whatever the case may be.

A bracket E (FIG. 7), which is an extended variation of the bracket C, is quite suitable for transferring a stabilizing force to a monolithic stab-on-grade foundation F composed of essentially a slab 60 and a peripheral wall 62 formed integral with the slab 60. This type of foundation is typically found in southern regions of the country where the frost line is quite shallow or nonexistent, and hence the peripheral wall possesses little depth. As such, it does not have the depth or strength of the typical basement wall for which the pin-type bracket of U.S. Pat. No. 4,708,528 is best suited. The foundation F is poured within a form, and as a consequence the peripheral wall 72 has a flat outside face 64.

The plate 12 of the bracket E has an extended width w—perhaps as much as 6 to 8 feet—and numerous bolt holes 16. It is placed against the flat outside face 64 of the foundation F at the location where the foundation F requires stabilizing, whereupon holes 16 are selected for receiving the bolts 22. The locations of these holes are marked on the foundation wall 62, whereupon the bracket C is removed and anchors 24 are set into the wall 62 at the selected locations. The bracket C is then repositioned against the foundation F and its plate 12 is secured against the wall 62 with bolts 22 that thread into the anchors 24.

Once the bracket E is fastened firmly to the foundation F, the jacking apparatus D is attached to the sleeve 14 of the bracket E. Thereupon, pier sections 30 are driven one after the other to provide a pier B which is secured to the sleeve 14 by bolts 26, all as previously described.

The bracket E with its extended width spreads the supporting force over a substantial length of the foundation wall 62, so that the wall 62, even though it is quite shallow, does not crack at the anchors 24. Indeed, the plate 12 of the bracket E imparts beam strength to the wall 62.

The extended bracket E is also useful for stabilizing a brick-faced foundation G (FIG. 8) which is similar to the foundation A in that it has a footing 2 and a foundation wall 4 poured upon the footing 2. In addition, the foundation G has a brick facing 70 which extends upwardly from the footing 2 against the foundation wall 4, as well as against a building wall 72 that rests on the foundation wall 4. The brick facing 70 consists of bricks laid up in a traditional bond and joined together with mortar joints. The facing 70 is further secured to at least the building wall 72 with typical wall anchors that embed in the mortar joints.

To stabilize the foundation G, the extended bracket E is lowered onto the footing 2 with its plate 12 against the brick facing 70. It is secured to the facing 70, and indeed to the foundation wall 4 as well, with expansion bolts 74 which pass-through the bolt holes 16 in the plate 12 as well as through the facing 70, and embed in the foundation wall 4.

After the footing 2 is broken away flush with the brick facing 70 in the region immediately below the sleeve 14 of the bracket E, the jacking apparatus D is attached to the sleeve 14 and pier sections 30 are driven through the sleeve 14, all as previously described.

The plate 12, by reason of its numerous bolt holes 16, distributes the supporting force over a wide area of the foundation G and supports the foundation G, even though the bolts 74 are of extended length. It imparts beam strength to the wall 4.

A modified bracket H is preferred for use on a foundation having a poured concrete wall 80. Like the bracket C, the bracket H has a rectangular plate 82 and a sleeve 84 attached to the plate 82 midway between the ends of the plate 82 with fillet welds, with the axis of the sleeve 84 being parallel to the major surface areas of the plate 82 and parallel to the shorter margins or side margins of the plate 82 as well. Thus, when the plate 82 is attached to the foundation wall 80 with the major axis of the plate 82 horizontal, the axis of the sleeve 84 is vertical. For a traditional residential foundation or a foundation for a light commercial building, the plate 82 may measure $8 \times 21 \times \frac{3}{4}$ inches, and the length of the sleeve 84 should at least equal the height of the plate 82. While the sleeve 84 may be longer than 21 inches, it should not be any shorter than about 18 to 20 inches. Its height should not be much less than about 8 inches.

The plate 82 on each aide of the sleeve 84 has three bolt holes 86. Two of the bolt holes 86 on either side of the sleeve 84 lie near the lower margin of the plate 82. The third bolt hole 86 on that side lies near the upper margin of the plate 84, but is otherwise generally centered with respect to the other two bolt holes 84. The diameter of the bolt holes 84 should be large enough to enable them to loosely receive $\frac{5}{8}$ inch diameter wedge anchors 86 which are conventional fastening devices.

The typical wedge anchor 88 has a shank provided with threads which run out to one of its ends and wedge-like anchoring devices at its opposite end. To install the anchor 88 in the poured concrete wall 80, a hole essentially the same diameter as the shank is drilled into the concrete wall 80, and then the anchor 88 is driven into the hole, its wedge-like anchoring devices leading, until the desired length of the threaded portion on the shank projects from the hole. That anchor 88 has a ⅝ inch diameter and is 6 inches long. 0f that 6 inches, 5 inches lies within the hole in the wall 80, so only about one inch projects beyond the surface of the foundation wall 80.

The anchors 88 are installed in the wall 80 in the pattern of the bolt holes 84 in the plate 82 of the bracket H. Indeed, the bracket H may be used as a template for establishing holes at the proper location relative to one another in the wall 80. Enough holes are drilled into the wall 80 and anchors 88 set in those holes to accommodate each one of the bolt holes 86 in the plate 82 of the bracket H. The holes may also be drilled into and anchors 88 set within a footing if one desires to attach the bracket H to a footing.

Of course, the bracket H is held against the wall 80 with the nuts 90 which thread over the outwardly projecting ends of the shanks for the anchors 88 and are turned down against the outwardly presented face of the plate 82. The spacing between any two bolt holes 86 in the plate 82 should be no less than the depth that the anchors 88 are embedded in the wall 80, and that is typically 5 inches.

Once the bracket H is attached to the wall 80, a workman attaches the jacking apparatus D to it and drives pier sections 30 into the ground, one after the other, until the pier B sc formed reaches the desired depth. Then, with the jacking apparatus D exerting a downwardly directed force on the pier B and an upwardly directed force on the foundation wall 80, the workman attaches the sleeve 84 of the bracket H to the last pier section 30 with bolts 22. The workman then releases the force exerted by the jacking apparatus D and removes the apparatus D. The pier B thus supports the foundation wall 80, inasmuch as it is attached to the wall 80 at the bracket H.

Typically, the pier B imparts a couple to the bracket H, and that couple tends to rotate the plate 82 about its upper margin and thereby tends to pull the lower margin of the plate 82 away from the wall 80, but the anchors 88 and nuts 90 restrain it. All of the anchors 88, however, accommodate the sheer force.

The triangular pattern of the bolt holes 86 and the anchors 88 on each side of the sleeve 84 produce a most effective attachment of the bracket H to the wall 80, one that takes the sheer load as well withstands the couple that tends to rotate the plate 84 about its upper margin. Yet the pattern keeps the bolt holes 86 to a minimum, and thus reduces the cost of manufacture for the bracket H and simplifies the installation of the bracket H on the wall 80.

This invention is intended to cover all changes and modifications of the example of the invention herein chosen for purposes of the disclosure which do not constitute departures from the spirit and scope of the invention.

What is claimed is:

1. In combination with a foundation that rests on underlying soil and includes a vertical wall, an improved device for stabilizing the foundation, said device comprising: a bracket having a plate and a sleeve which is fastened securely and rigidly to the plate, the plate being substantially wider than the sleeve and projecting beyond both sides of the sleeve, the plate being located against the wall without extending beneath the wall or the foundation, the plate having one of its faces directly against the wall, with the axis of the sleeve being oriented generally vertically; a plurality of fasteners extended through the plate on each side of the sleeve and being anchored in the wall to securely and rigidly attach the brackets to the wall such that the plate cannot pull away from the wall, whereby the sleeve is presented rigidly along the wall such that it cannot rotate relative to the wall about any axis; a pier extended vertically downwardly through the sleeve of the bracket and into the underlying soil and having its upper end located within and confined in all lateral directions by the sleeve such that the upper end of the pier remains vertical and cannot be displaced from the vertical; and connecting means for attaching the upper end of the pier to the sleeve so that the pier cannot shift vertically with respect to the bracket and foundation wall, whereby the pier supports the foundation wall.

2. The combination according to claim 1 wherein the pier is tubular and the connecting means comprises bolts which are threaded generally radially into the sleeve and pass through the wall of the tubular pier so as to attach the pier to the sleeve.

3. The combination according to claim 1 wherein the plate has a plurality of bolt holes on each side of the sleeve; and the fasteners comprise bolts extended through at least some of the bolt holes on each side of the sleeve and anchored in the wall.

4. The combination according to claim 1 wherein the sleeve is generally midway between the ends of the plate.

5. The combination according to claim 1 wherein the wall is formed from blocks laid up in tiers and the plate of the bracket lies over and is attached to at least two blocks in a single tier of the wall.

6. The combination according to claim 1 wherein the wall is formed integral with a slab.

7. The combination according to claim 6 wherein the wall is only slightly higher than the plate of the bracket.

8. The combination according to claim 1 wherein the plate has three holes on each side of the sleeve, with one of the holes being located above the other holes and the other holes being generally at the same elevation.

9. A process for stabilizing a foundation which rests on underlying soil and includes an upright wall, said process comprising: attaching to the wall a bracket having a plate and a sleeve fastened securely and rigidly to the plate intermediate the ends of the plate so that the plate extends beyond both sides of the sleeve, the bracket being attached firmly and rigidly to the wall without extending beneath the wall or the foundation and with its plate being directly against the wall and with the axis of its sleeve being oriented vertically, all such that the plate cannot pull away from the wall and the sleeve cannot rotate relative to the wall about any axis; connecting a jacking apparatus to the sleeve of bracket, with the jacking apparatus including a fluid-operated cylinder located over the sleeve and tie means for attaching the cylinder to the sleeve such that the axis of the cylinder is aligned with the axis of the sleeve, the tie means having a space located between the cylinder and the sleeve for receiving pier sections; inserting pier sections into the space of the tie means one after the other and forcing them through the sleeve and into the underlying soil with the cylinder to form a pier which extends downwardly from the sleeve and is confined in all lateral directions and is maintained truly vertical at its upper end by the sleeve; and while the cylinder applies a downwardly directed force to the last pier section, attaching that pier section to the sleeve so that it cannot move vertically in the sleeve, whereby the foundation wall is supported on the pier formed by the pier sections.

10. The process according to claim 9 wherein the step of attaching the bracket to the wall includes inserting bolts, through the plate and threading them into anchors in the wall.

11. The process according to claim 9 wherein the wall is formed from blocks laid up in tiers, and the step of attaching the bracket includes placing the plate of the bracket over at least two blocks of a single tier and attaching the plate of both of the blocks.

12. The process according to claim 9 wherein the wall is formed integral with a slab.

13. The process according to claim 12 wherein the wall is only slightly higher than the plate of the bracket.

14. In combination with a concrete slab poured on underlying soil and a shallow wall of poured concrete located around the slab and also resting on the underlying soil, the wall having a vertical surface that is presented outwardly away from the slab, an improved device for stabilizing the concrete wall and slab, said device comprising: a bracket having a plate and a sleeve that is fastened securely and rigidly to the plate, the plate being substantially longer than it is high and having one of its faces directly against the outwardly presented vertical surface of the shallow wall, the plate extending a substantial distance along that surface without being beneath the wall or the foundation and positioning the sleeve with the axis of the sleeve oriented vertically, the plate extending a substantial distance beyond both sides of the sleeve and having a plurality of holes located on both sides of the sleeve; fasteners extended through at least some of the holes in the plate on both sides of the sleeve and into the wall to which they are firmly attached such that the plate cannot pull away from the wall, whereby the bracket is held securely and rigidly against the wall, with the axis of the sleeve being oriented vertically and the sleeve being prevented from rotating relative to the wall about any axis; a pier extended vertically downwardly from the bracket and having its upper end located within and confined in all lateral directions by the sleeve of the bracket, so that the upper end of the pier remains truly vertical and cannot be displaced from the vertical; and connecting means for attaching the pier to the sleeve to prevent the sleeve from moving vertically over the pier, whereby the pier supports the wall.

15. The combination according to claim 14 wherein the slab is formed integral with the wall.

16. The combination according to claim 15 wherein the upper edge of the plate for the bracket is adjacent to the top of the slab.

17. The combination according to claim 14 wherein the fasteners comprise bolts which pass through the holes in the plate and are anchored in the wall.

18. The combination according to claim 14 wherein the connecting means comprises at least one bolt threaded through the sleeve of the bracket and extended into the pier.

19. The combination according to claim 14 wherein the plate for the bracket is about as high as a foundation wall so the upper edge of the plate is located close to the upper surface of the slab and the lower edge of the plate is located close to the bottom of the wall.

* * * * *

UNITED STATES PATENT AND TRADEMARK OFFICE

CERTIFICATE OF CORRECTION

PATENT NO. : 5,234,287

DATED : August 10, 1993

INVENTOR(S) : Dondeville M. Rippe, Jr.

It is certified that error appears in the above-identified patent and that said Letters Patent is hereby corrected as shown below:

Column 6, line 52 - cancel "8x21x3/4" and substitute therefor "8x21x3/8"

Column 7, line 6 - between "That" and "anchor" insert --- portion of the shank accommodates a nut 90. Preferably, the ---

Signed and Sealed this

Eighth Day of March, 1994

Bruce Lehman

*Attest:*

BRUCE LEHMAN

*Attesting Officer*

*Commissioner of Patents and Trademarks*